US011021971B2

(12) United States Patent
Holowczak et al.

(10) Patent No.: US 11,021,971 B2
(45) Date of Patent: Jun. 1, 2021

(54) CMC BLADE WITH MONOLITHIC CERAMIC PLATFORM AND DOVETAIL

(71) Applicant: United Technologies Corporation, Farmington, CT (US)

(72) Inventors: John E. Holowczak, Windsor, CT (US); Michael G. McCaffrey, Windsor, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 1138 days.

(21) Appl. No.: 15/025,949

(22) PCT Filed: Sep. 17, 2014

(86) PCT No.: PCT/US2014/056030
§ 371 (c)(1),
(2) Date: Mar. 30, 2016

(87) PCT Pub. No.: WO2015/053911
PCT Pub. Date: Apr. 16, 2015

(65) Prior Publication Data

US 2016/0222802 A1 Aug. 4, 2016

Related U.S. Application Data

(60) Provisional application No. 61/890,005, filed on Oct. 11, 2013.

(51) Int. Cl.
*F01D 5/28* (2006.01)
*F01D 5/30* (2006.01)
(Continued)

(52) U.S. Cl.
CPC ..... *F01D 5/282* (2013.01); *F01D 5/147* (2013.01); *F01D 5/284* (2013.01); *F01D 5/30* (2013.01);
(Continued)

(58) Field of Classification Search
CPC ..... F01D 5/147; F01D 5/282; F01D 5/284; F01D 5/30; F01D 5/3007; F01D 5/3084;
(Continued)

(56) References Cited

U.S. PATENT DOCUMENTS 4,019,832 A 4/1977 Salemme et al.
5,318,406 A * 6/1994 Bardes ..... B23P 15/04 29/889.21
(Continued)

FOREIGN PATENT DOCUMENTS

JP H02196104 8/1990
JP 2007071185 3/2007
(Continued)

OTHER PUBLICATIONS

The International Preliminary Report on Patentability for PCT Application No. PCT/US2014/056030, dated Apr. 21, 2016.
(Continued)

*Primary Examiner* — J. Todd Newton
*Assistant Examiner* — Christopher R Legendre
(74) *Attorney, Agent, or Firm* — Carlson, Gaskey & Olds, P.C.

(57) ABSTRACT

A blade for a gas turbine engine includes a fiber reinforced ceramic matrix composite structure that provides an airfoil with an exposed exterior airfoil surface and a refractory structure that provides at least an outer portion of a root secured relative to the airfoil.

19 Claims, 1 Drawing Sheet

(51) Int. Cl.
*F01D 5/14* (2006.01)
*F01D 11/00* (2006.01)

(52) U.S. Cl.
CPC ..... *F01D 5/3007* (2013.01); *F01D 5/3084* (2013.01); *F01D 5/3092* (2013.01); *F01D 11/008* (2013.01); *F05D 2220/32* (2013.01); *F05D 2240/80* (2013.01); *F05D 2300/13* (2013.01); *F05D 2300/2261* (2013.01); *F05D 2300/2283* (2013.01); *F05D 2300/606* (2013.01); *F05D 2300/607* (2013.01); *F05D 2300/6033* (2013.01)

(58) Field of Classification Search
CPC ..... F01D 5/3092; F05D 2240/80; F05D 2300/13; F05D 2300/2261; F05D 2300/2283; F05D 2300/6033; F05D 2300/606; F05D 2300/607
See application file for complete search history.

(56) References Cited

U.S. PATENT DOCUMENTS

| | | | | |
|---|---|---|---|---|
| 5,449,649 | A | 9/1995 | Li et al. | |
| 6,451,416 | B1 | 9/2002 | Holowczak et al. | |
| 6,696,144 | B2 | 2/2004 | Holowczak et al. | |
| 7,258,530 | B2 * | 8/2007 | Morrison | F01D 5/147 29/889.71 |
| 7,329,101 | B2 * | 2/2008 | Carper | C04B 35/565 416/219 R |
| 8,251,651 | B2 | 8/2012 | Propheter-Hinckley et al. | |
| 9,376,916 | B2 * | 6/2016 | McCaffrey | F01D 5/147 |
| 9,598,967 | B2 * | 3/2017 | Xu | F01D 5/30 |
| 2005/0158171 | A1 | 7/2005 | Carper et al. | |
| 2009/0257875 | A1 | 10/2009 | McCaffrey et al. | |
| 2012/0055609 | A1 | 3/2012 | Blanchard et al. | |
| 2012/0063912 | A1 | 3/2012 | Bouillon et al. | |
| 2012/0163986 | A1 * | 6/2012 | Darkins, Jr. | F01D 5/282 416/241 B |
| 2013/0004325 | A1 | 1/2013 | McCaffrey et al. | |
| 2013/0004326 | A1 | 1/2013 | McCaffrey | |
| 2013/0011271 | A1 * | 1/2013 | Shi | F01D 5/28 416/230 |
| 2013/0064668 | A1 * | 3/2013 | Paige, II | F01D 5/284 416/219 R |
| 2013/0171001 | A1 | 7/2013 | Andres Jose | |
| 2014/0271208 | A1 * | 9/2014 | Garcia-Crespo | F01D 5/30 416/194 |
| 2016/0040539 | A1 * | 2/2016 | McCaffrey | F01D 5/147 60/805 |
| 2016/0222800 | A1 * | 8/2016 | Kleinow | F01D 5/22 |
| 2016/0222802 | A1 * | 8/2016 | Holowczak | F01D 5/147 |
| 2016/0230568 | A1 * | 8/2016 | Sippel | F01D 9/041 |

FOREIGN PATENT DOCUMENTS

| | | |
|---|---|---|
| WO | 2015009386 | 1/2015 |
| WO | 2015047485 | 4/2015 |
| WO | 2015080781 | 6/2015 |

OTHER PUBLICATIONS

Extended European Search Report for European Application No. 14852996.9 dated Oct. 19, 2016.
International Search Report and Written Opinion for PCT/US2014/056030 dated Dec. 12, 2014.

* cited by examiner

CMC BLADE WITH MONOLITHIC CERAMIC PLATFORM AND DOVETAIL

CROSS-REFERENCE TO RELATED APPLICATIONS

This application claims priority to U.S. Provisional Application No. 61/890,005, which was filed on Oct. 11, 2013 and is incorporated herein by reference.

BACKGROUND

This disclosure relates to a ceramic matrix composite blade with a monolithic ceramic portion.

Gas turbine engines may be made more efficient, in part, by increasing engine operating temperatures. Exotic metallic components within the engine are already near their maximum operating temperatures. To further increase temperatures within the engine, both monolithic ceramic and fiber reinforced ceramic matrix composite (CMC) components are increasingly used and have higher temperature capabilities than more conventional materials.

Ceramic composite blades have been proposed in which CMC layers extend from the root to the airfoil tip. The CMC layers are encased in a monolithic ceramic that extends from the dovetail (root) to the airfoil tip. The monolithic ceramic also provides the platform.

SUMMARY

In one exemplary embodiment, a blade for a gas turbine engine includes a fiber reinforced ceramic matrix composite structure that provides an airfoil with an exposed exterior airfoil surface and a refractory structure that provides at least an outer portion of a root secured relative to the airfoil.

In a further embodiment of the above, the ceramic matrix composite structure includes an inner root. The outer portion of the root is secured over the inner root. The refractory structure includes substantially isotropic, monolithic refractory material including but not limited to silicon nitride, silicon carbide, aluminum nitride, molybdenum silicide, molybdenum-silicon-boron alloy, and admixtures thereof.

In a further embodiment of any of the above, the outer portion includes angled walls that provide a dovetail.

In a further embodiment of any of the above, the inner root includes a root end that extends beyond the angled walls.

In a further embodiment of any of the above, the refractory structure includes a platform.

In a further embodiment of any of the above, the refractory structure has a neck interconnecting the outer portion to the platform.

In a further embodiment of any of the above, the platform includes an aperture through which the airfoil extends.

In a further embodiment of any of the above, the platform surrounds a perimeter of airfoil.

In a further embodiment of any of the above, the ceramic matrix composite structure provides a fillet arranged about the perimeter and overlaps the platform and the airfoil.

In a further embodiment of any of the above, the refractory structure includes an integral fillet that is arranged about the perimeter.

In another exemplary embodiment, a rotating assembly for a gas turbine engine includes a rotor including a slot, a blade that has a fiber reinforced ceramic matrix composite structure that provides an airfoil with an exposed exterior airfoil surface, and a refractory structure that provides at least an outer portion of a root that is secured relative to the airfoil and received in the slot.

In a further embodiment of the above, the ceramic matrix composite structure includes an inner root. The outer portion is secured over the inner root. The refractory structure includes substantially isotropic, monolithic refractory material including but not limited to silicon nitride, silicon carbide, aluminum nitride, molybdenum silicide, molybdenum-silicon-boron alloy, and admixtures thereof.

In a further embodiment of any of the above, the outer portion includes angled walls that provide a dovetail. The dovetail engages the rotor within the slot.

In a further embodiment of any of the above, the inner root includes a root end that extends beyond the angled walls.

In a further embodiment of any of the above, the refractory structure includes a platform that extends circumferentially to opposing mate faces. The mate face is arranged proximate to adjacent mate faces of adjacent blades supported by the rotor.

In a further embodiment of any of the above, the refractory structure has a neck that interconnects the outer portion to the platform.

In a further embodiment of any of the above, the platform includes an aperture through which the airfoil extends.

In a further embodiment of any of the above, the platform surrounds a perimeter of airfoil.

In a further embodiment of any of the above, the ceramic matrix composite structure provides a fillet arranged about the perimeter and overlaps the platform and the airfoil.

In a further embodiment of any of the above, the refractory structure includes an integral fillet that is arranged about the perimeter.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
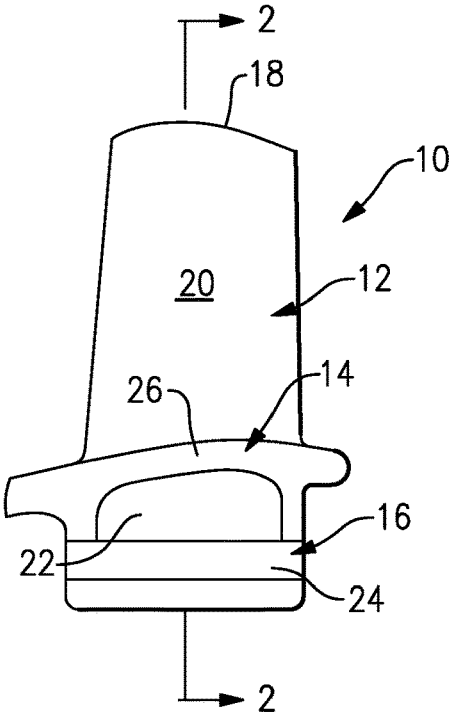
FIG. 1 is a schematic side view of an example turbine blade.
Figure 2:
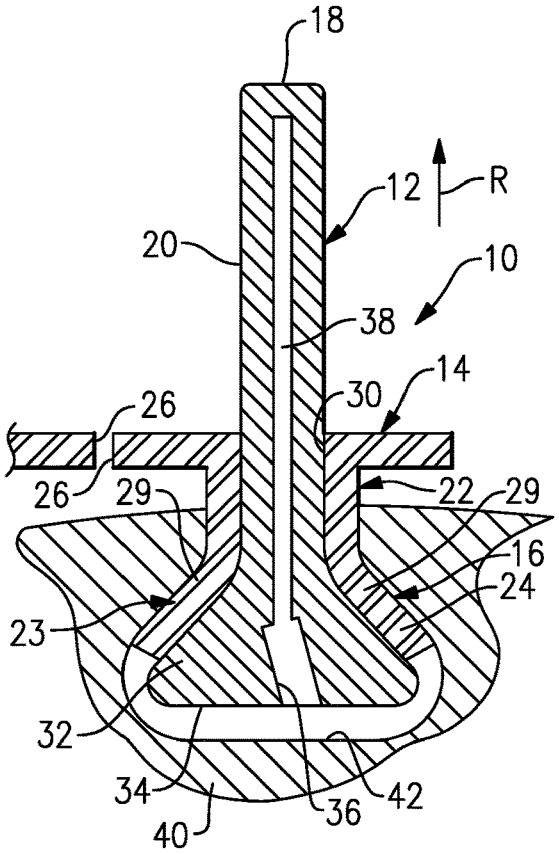
FIG. 2 is a highly schematic cross-sectional view of the blade shown in FIG. 1 arranged in a rotor slot.

A turbine blade 10 is schematically shown in FIG. 1. The blade 10 includes an airfoil 12 extending in a radial direction from a platform 14 to a tip 18. The platform 14 is supported by a root 16, which is received in a slot 42 of a rotor 40 of gas turbine engine, as shown in FIG. 2. With continuing reference to FIG. 1, a neck 22 is provided between the root 16 and the platform. The airfoil 12 includes an exterior airfoil surface 20, and the root 16 includes an exterior root surface 24.

The blade 10 is constructed from a fiber reinforced ceramic matrix composite structure and a refractory structure secured to one another. In the example, the ceramic matrix composite structure provides the airfoil 12, and the refractory structure provides the platform 14. The ceramic matrix composite structure together with the refractory structure provides the root 16. In one example, the refractory structure is an isotropic material such as monolithic ceramics and Mo-SIB.

Referring to FIG. 2, a ceramic matrix composite structure provides the airfoil 12 connected to an inner root 32 by an inner neck. Although not needed for certain ceramic blade applications, cooling flow inlet 36 may be provided in the inner root 32 to supply a cooling fluid to a cooling passage 38 in the airfoil 12.

The ceramic matrix composite portion of the structure is typically constructed from multiple composite layers. In one example method of manufacture, silicon-carbide fibers are coated with a pre-ceramic polymer resin to provide a layer. In one example, multiple layers are stacked into plies, and the plies are arranged about a form in the shape of an article. The pre-ceramic polymer is pyrolyzed to produce ceramic matrix composite structure of, for example, silicon carbide, silicon oxycarbide, and silicon oxy carbonitride. The matrix of ceramic matrix composite structure can be formed by other methods if desired, for example, by chemical vapor infiltration (CVI) or melt infiltration using glasses or silicon metal. Multiple types of matrix infiltration may be used if desired.

The ceramic matrix composite structure provides the exterior airfoil surface 20, which can better withstand impact from foreign object debris than, for example, a monolithic ceramic. In the example, the entire airfoil 12 is made from ceramic matrix composite. The ceramic matrix composite structure also provides the strength and durability needed to transfer centrifugal loads on the blade 10 to the rotor 40.

The refractory structure provides an outer portion or outer root 23, the outer neck 22 and the platform 14. More complex platform shapes can be formed of the refractory structure than ceramic matrix composite. The outer root 23 is provided by angled walls 19 that form a dovetail, which engages the rotor 40 within the slot 42. A root end 34 of the inner root 32 extends beyond the angled walls 29. The refractory structure is easier to machine than ceramic matrix composite and can be machined, for example, by diamond grinding, to tighter tolerances. When machining CMCs to high tolerance, exposing or grinding through fibers is undesirable due to creation of stress concentrations and exposure of the fiber/matrix interface to environmental effects.

Figure 3:
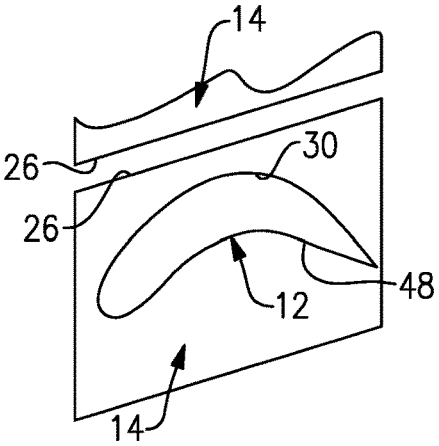
FIG. 3 is a top view of the blade shown in FIG. 1.

Referring to FIGS. 2 and 3, circumferential sides of the platform 16 include mating faces 26 that are arranged adjacent to the platforms of adjacent blades. The platform 14, which provides the inner flow path surface of the engine's core flow path, is relatively free of foreign object debris such that the additional strength provided by the fibers in the CMC structure should not be needed.

The refractory structure provides an aperture 30, shown in FIGS. 2 and 3, through which the airfoil 12 extends. As a result, the refractory structure surrounds a perimeter 48 of the airfoil 12.

Figure 5:
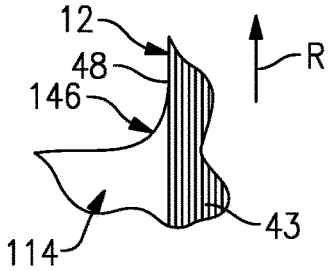
FIG. 5 is another example of a fillet provided between the platform and the airfoil.
Figure 4:
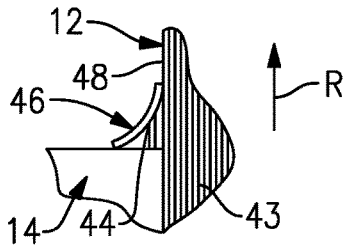
FIG. 4 is one example of a fillet provided between a platform and an airfoil.

It may be desirable to provide a fillet 46 between the platform 14 and the airfoil 12 for aerodynamic efficiency. The "airfoil" is the portion that extends beyond the platform or platform fillet, if used. As shown in FIG. 4, overlapping layers 44 of ceramic matrix composite, for example, are arranged about the perimeter 48 and over the ceramic matrix composite layers 43 of the airfoil 12 to provide a smooth transition between the airfoil 12 and the platform 14. In another example shown in FIG. 5, the fillet 146 is integral with the refractory structure and provided by the platform 114.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A blade for a gas turbine engine comprising:

a fiber reinforced ceramic matrix composite structure providing an airfoil with an exposed exterior airfoil surface; and a non-metallic, monolithic, isotropic refractory structure including a platform and providing at least an outer portion of a root secured relative to the airfoil.

2. The blade according to claim 1, wherein the ceramic matrix composite structure includes an inner root, and the outer portion of the root is secured over the inner root, the refractory structure including any of silicon nitride, silicon carbide, aluminum nitride, molybdenum silicide, molybdenum-silicon-boron alloy, or admixtures thereof.

3. The blade according to claim 2, wherein the outer portion includes angled walls that provide a dovetail.

4. The blade according to claim 3, wherein the inner root includes a root end that extends beyond the angled walls.

5. The blade according to claim 1, wherein the refractory structure has a neck interconnecting the outer portion to the platform.

6. The blade according to claim 1, wherein the platform includes an aperture through which the airfoil extends.

7. The blade according to claim 6, wherein the platform surrounds a perimeter of the airfoil.

8. The blade according to claim 1, wherein the ceramic matrix composite structure provides a fillet arranged about a perimeter of the air foil and overlapping the platform and the airfoil.

9. The blade according to claim 1, wherein the refractory structure includes an integral fillet arranged about a perimeter of the airfoil.

10. A rotating assembly for a gas turbine engine comprising:

a rotor including a slot; and a blade having a fiber reinforced ceramic matrix composite structure that provides an airfoil with an exposed exterior airfoil surface, and a non-metallic, monolithic, isotropic refractory structure including a platform and providing at least an outer portion of a root secured relative to the airfoil and received in the slot.

11. The rotating assembly according to claim 10, wherein the ceramic matrix composite structure includes an inner root, and the outer portion is secured over the inner root, the refractory structure including any of silicon nitride, silicon carbide, aluminum nitride, molybdenum silicide, molybdenum-silicon-boron alloy, or admixtures thereof.

12. The rotating assembly according to claim 11, wherein the outer portion includes angled walls that provide a dovetail, the dovetail engaging the rotor within the slot.

13. The rotating assembly according to claim 12, wherein the inner root includes a root end that extends beyond the angled walls.

14. The rotating assembly according to claim 13, wherein the platform extends circumferentially to opposing mate faces, the mate faces arranged proximate to adjacent mate faces of adjacent blades supported by the rotor.

15. The rotating assembly according to claim 14, wherein the refractory structure has a neck interconnecting the outer portion to the platform.

16. The rotating assembly according to claim 14, wherein the platform includes an aperture through which the airfoil extends.

17. The rotating assembly according to claim 16, wherein the platform surrounds a perimeter of the airfoil.

18. The rotating assembly according to claim 14, wherein the ceramic matrix composite structure provides a fillet arranged about a perimeter of the airfoil and overlapping the platform and the airfoil.

19. The rotating assembly according to claim 14, wherein the refractory structure includes an integral fillet arranged about a perimeter of the airfoil.

* * * * *